US009671801B2

(12) United States Patent
Bhattad et al.

(10) Patent No.: US 9,671,801 B2
(45) Date of Patent: Jun. 6, 2017

(54) APPARATUS AND METHOD FOR A VOLTAGE REGULATOR WITH IMPROVED POWER SUPPLY REDUCTION RATIO (PSRR) WITH REDUCED PARASITIC CAPACITANCE ON BIAS SIGNAL LINES

(71) Applicant: Dialog Semiconductor GmbH, Kirchheim/Teck-Nabern (DE)

(72) Inventors: Ambreesh Bhattad, Swindon (GB); Ludmil Nikolov, Chippenham (GB)

(73) Assignee: Dialog Semiconductor GmbH, Kirchhiem/Teck-Nabern (DE)

( * ) Notice: Subject to any disclaimer, the term of this patent is extended or adjusted under 35 U.S.C. 154(b) by 0 days.

(21) Appl. No.: 14/073,106

(22) Filed: Nov. 6, 2013

(65) Prior Publication Data

US 2015/0123628 A1 May 7, 2015

(51) Int. Cl.
*G05F 1/563* (2006.01)
*G05F 1/575* (2006.01)

(52) U.S. Cl.
CPC ..... *G05F 1/563* (2013.01); *G05F 1/575* (2013.01)

(58) Field of Classification Search
CPC . G05F 1/56; G05F 1/466; G05F 1/467; G05F 1/575; G05F 1/563
See application file for complete search history.

(56) References Cited

U.S. PATENT DOCUMENTS 5,479,132 A * 12/1995 Verhaeghe et al. ..... 327/553
5,528,129 A * 6/1996 Kaneko ..... G05F 3/247 323/313
5,861,771 A * 1/1999 Matsuda et al. ..... 327/540
6,100,833 A 8/2000 Park
6,265,856 B1 * 7/2001 Cali' ..... G05F 1/575 323/273
6,433,510 B1 * 8/2002 Ribellino ..... H02J 7/0072 320/128
6,509,727 B2 * 1/2003 Fahrenbruch ..... G05F 1/565 323/316
6,690,147 B2 * 2/2004 Bonto ..... G05F 1/575 323/273
6,933,772 B1 * 8/2005 Banerjee ..... G05F 1/565 323/277
6,989,660 B2 * 1/2006 Mauthe ..... G05F 1/465 323/274

(Continued)

*Primary Examiner* — Thomas J Hiltunen

(74) *Attorney, Agent, or Firm* — Saile Ackerman LLC; Stephen B. Ackerman

(57) ABSTRACT

An apparatus and method for a system with improved power supply rejection ratio (PSRR) over a wide frequency range. The improved PSRR is achieved by negating the influence of the parasitic capacitance associated with the bias lines and the introduction of a regulated power supply with embodiments associated with providing a ripple free and regulated supply. With reduction of parasitic capacitance, and providing an ENABLE switch by a pre-regulated supply, the degradation of the PSRR is achieved. The embodiments include both n-channel and p-channel MOSFETs implementations, and a positive and negative regulated power supply voltage. With the combined influence of the utilization of the VREG supply, and the lowering of battery-to-bias line capacitance using design layout and improved floor planning an improved PSRR over a wide frequency distribution is achieved.

17 Claims, 6 Drawing Sheets

(56) References Cited

U.S. PATENT DOCUMENTS 7,071,664 B1 * 7/2006 Teggatz ..... H02J 7/0063 323/273
7,394,302 B2 * 7/2008 Shimazawa ..... 327/277
7,443,977 B1 10/2008 Toumani et al.
7,675,273 B2 * 3/2010 Ko ..... G05F 1/575 323/269
7,830,200 B2 * 11/2010 Rao et al. ..... 327/540
7,863,969 B2 * 1/2011 Furuya ..... G05F 1/563 323/266
8,125,204 B2 * 2/2012 Liu ..... G05F 1/575 323/274
8,198,877 B2 * 6/2012 Kuan et al. ..... 323/280
8,436,595 B2 * 5/2013 Simmons ..... G05F 1/575 323/273
8,525,716 B2 9/2013 Bhatia et al.
8,686,698 B2 * 4/2014 Lopata ..... H02M 3/1588 323/224
8,692,529 B1 * 4/2014 Wyatt ..... G05F 1/56 323/270
8,773,105 B1 * 7/2014 Kang et al. ..... 323/315
8,854,022 B2 * 10/2014 Motz ..... G05F 1/575 323/273
8,917,070 B2 * 12/2014 El-Nozahi et al. ..... 323/273
2005/0275375 A1 * 12/2005 Liu et al. ..... 320/128
2006/0001099 A1 * 1/2006 Motz ..... 257/355
2006/0152284 A1 * 7/2006 Morino ..... G05F 1/575 330/260
2009/0206813 A1 * 8/2009 Agari ..... G05F 1/56 323/282
2012/0105047 A1 * 5/2012 Huang ..... G05F 1/575 323/351
2012/0146595 A1 * 6/2012 Wong ..... 323/265
2012/0242307 A1 * 9/2012 Higuchi ..... H02M 3/156 323/273
2012/0268208 A1 * 10/2012 Takenaka ..... G11C 5/147 330/260
2013/0057335 A1 * 3/2013 Kawai ..... G05F 1/56 327/537

* cited by examiner

APPARATUS AND METHOD FOR A VOLTAGE REGULATOR WITH IMPROVED POWER SUPPLY REDUCTION RATIO (PSRR) WITH REDUCED PARASITIC CAPACITANCE ON BIAS SIGNAL LINES

BACKGROUND

Field

The disclosure relates generally to a linear voltage regulator circuits and, more particularly, to a linear voltage regulator circuit device having improved power supply reduction ratio (PSRR) thereof.

Description of the Related Art

Linear voltage regulators are a type of voltage regulators used in conjunction with semiconductor devices, integrated circuit (IC), battery chargers, and other applications. Linear voltage regulators can be used in digital, analog, and power applications to deliver a regulated supply voltage. In power management semiconductor chips, it is desirable to consume the least amount of power possible to extend the battery power. In the initialization of a power management semiconductor chip, a bias current is needed for the internal nodes and branches. This start-up bias current establishes a pre-condition state for many power applications. The bias current magnitude should be a low value to extend battery life. With the reduction of the bias current, leads to bias lines to become high impedance. Additionally, with the reduction of the bias current, noise has a larger influence. The noise signals enter the system through the parasitic capacitance. With the long bias lines on the order of milli-meters, the magnitude of the capacitance, and the noise signal is significant, and impacts the power supply rejection ratio (PSRR).

In systems today, the design methodology typically provide two different methods for biasing for global biasing and local biasing. Current biasing is used for global biasing. Voltage biasing is used for local biasing within the functional block. In an example of a system known to the inventors, a system floorplan design can contain a plurality of digital blocks, a bias block 30, and routing lines. In a large system, the routing lines can be of significant length leading to power supply reduction ratio (PSRR) degradation.

In linear voltage regulators, usage of isolation circuits has been discussed. As discussed in published U.S. Pat. No. 8,525,716 to Bhatia et al describes an isolation network. An electronic circuit comprises a digital-to-analog converter (DAC) core circuit having a current source device and a digital input bit. An isolation circuit is also provided and is connected to the DAC core circuit. The isolation circuit is configured to selectively provide a source bias signal to the current source device. The isolation circuit also is configured to isolate the source bias signal from the current source device based on a state of the digital input bit.

In low dropout regulators, establishing line drivers that address bias supply issues have been discussed. As discussed in U.S. Pat. No. 7,443,977 to Toumani et al., discloses a line driver which includes: at least one amplifier, a delay element, a control signal generator and a generator. At least one amplifier includes at least one bias supply, a signal input and a signal output. The delay element accepts as an input the data signal and delays delivery of the data signal to the at least one line amplifier for amplification. The generator is responsive to a control signal to generate varying voltage levels corresponding thereto on the at least one bias supply of the at least one amplifier. The control signal generator is responsive to the input data signal to detect peaks therein and to generate the control signal corresponding thereto in advance of delivery of the data signal to the amplifier.

In digital-to-analog converter (DAC) circuit utilizes a bias circuit. As discussed in U.S. Pat. No. 6,100,833 to Park et al, describes a digital to analog converter and bias network. A b-bit digital and analog converter addressed non-expensive and monotonic with relatively high differential and integral non-linearities. The converter uses weighed current ratio to achieve decrease the number of current cells to provide a cumulative current which corresponds to the digital value on the input data bus.

In these prior art embodiments, the solution to improve the response for bias line issues utilized various alternative solutions.

It is desirable to provide a solution to address the disadvantages of the low dropout (LDO) regulator for improved PSRR.

SUMMARY

A principal object of the present disclosure is to provide a circuit implementation which lessens the impact of parasitic capacitance associated with bias lines.

A principal object of the present disclosure is to provide a circuit that reduces the impact of parasitic capacitance on power supply rejection ratio (PSRR) of analog functional blocks.

Another further object of the present disclosure is to provide a circuit device with analog blocks that reduces the standby current for the system.

Another further object of the present disclosure is to provide a circuit device with an enabling switch driven by a pre-regulated supply.

The above and other objects are achieved by a low dropout device with improved power supply reduction ratio (PSRR). The device comprising a p-channel MOSFET pull-up, an n-channel MOSFET switch, a digital gate driven by a ripple free battery pre-regulated filtered power source, a battery voltage source, and a ground.

The above and other objects are further achieved by a system with improved power supply rejection ratio (PSRR), the system comprising a regulated power supply, a bias control block electrically connected to said regulated power supply, providing a bias control function, a functional block electrically connected to the bias control block, and a bias line electrically coupling said bias control block and said functional block.

The above and other objects are further achieved by a system with improved power supply rejection ratio (PSRR), the system comprising of a regulated power supply, an enabling switch electrically connected to said regulated power supply, providing an enabling function, a functional block electrically connected to the enabling switch, and a bias line electrically coupling said enabling switch and said functional block.

The above and other objects are further achieved by a system with improved power supply rejection ratio (PSRR), the device comprising an enabling switch providing an enabling function, a low pass filter electrically coupled to the output of said enabling switch, a functional block electrically coupled to said low pass filter, and a bias line electrically coupling said low pass filter and said functional block.

The above and other objects are further achieved by a system with improved power supply rejection ratio (PSRR), the device comprising a regulated power supply, an enabling switch electrically connected to said regulated power supply, providing an enabling function a low dropout (LDO) regulator electrically connected to the enabling switch; and a bias line electrically coupling said enabling switch and said low dropout (LDO) regulator.

The above and other objects are further achieved by a method of improved power supply rejection ratio (PSRR) frequency dependence in a system comprising the steps of providing a system comprising a functional block, a master bias network, an enabling switch, a bias line, and a regulated power supply, feeding a regulated voltage to said enabling switch, feeding a voltage representing a voltage supply to said functional block; and minimizing bias line parasitic capacitance for improved power supply rejection ratio (PSRR) through design layout.

The above and other objects are further achieved by a method of improved power supply rejection ratio (PSRR) frequency dependence in a system comprising the steps of providing a system comprising a functional block, a master bias network, an enabling switch, a bias line, a low pass filter (LPF) and a regulated power supply, feeding a regulated voltage to said enabling switch, filtering the output of said enable switch using said low pass filter (LPF), and minimizing bias line parasitic capacitance for improved power supply rejection ratio (PSRR) through design layout.

As such, a novel low dropout (LDO) device with an improved power supply rejection ratio (PSSR) over a wide frequency range. Other advantages will be recognized by those of ordinary skill in the art.

BRIEF DESCRIPTION OF THE DRAWINGS

The present disclosure and the corresponding advantages and features provided thereby will be best understood and appreciated upon review of the following detailed description of the disclosure, taken in conjunction with the following drawings, where like numerals represent like elements, in which.

DETAILED DESCRIPTION

Figure 1:
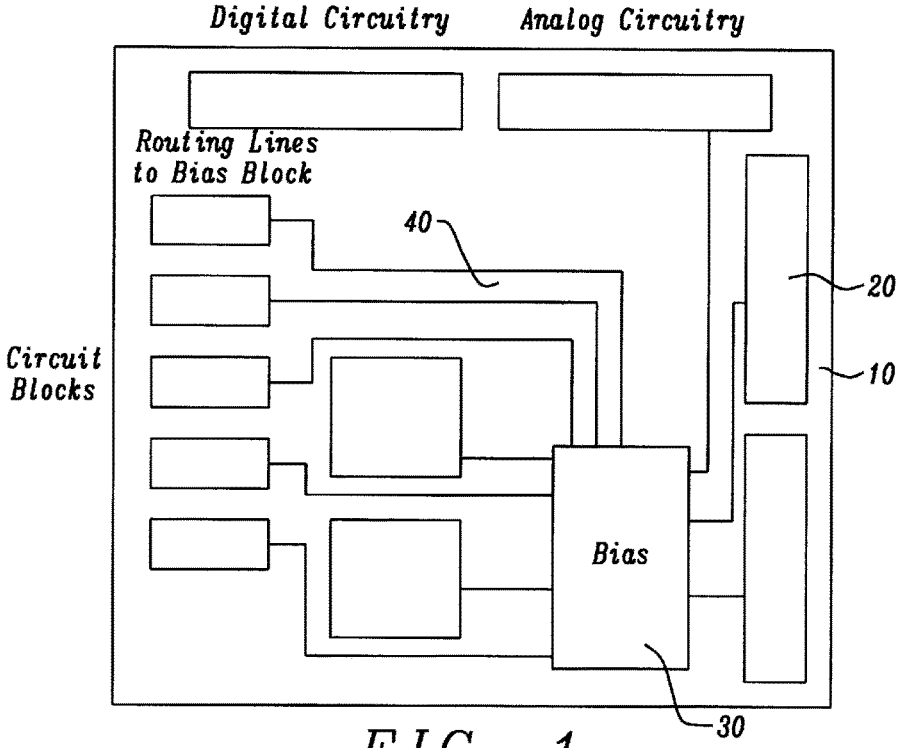
FIG. 1 is an example of a system floor plan.

FIG. 1 shows the full system 1 illustrating an embodiment known to the inventor. In systems today, the design methodology typically provide two different methods for biasing for global biasing and local biasing. Current biasing is used for global biasing. Voltage biasing is used for local biasing within the functional block. In an example of a system known to the inventors, a system floor plan design is illustrated in FIG. 1. FIG. 1 shows the full system 1 containing a plurality of circuit blocks 20, a bias block 30, and routing lines 40. The routing lines 40 show the routing from the bias block 30 to the plurality of blocks 20 for the bias current. In a large system, the routing lines can be of significant length leading to power supply reduction ratio (PSRR) degradation. Bias lines are not routed to digital blocks.

Figure 2:
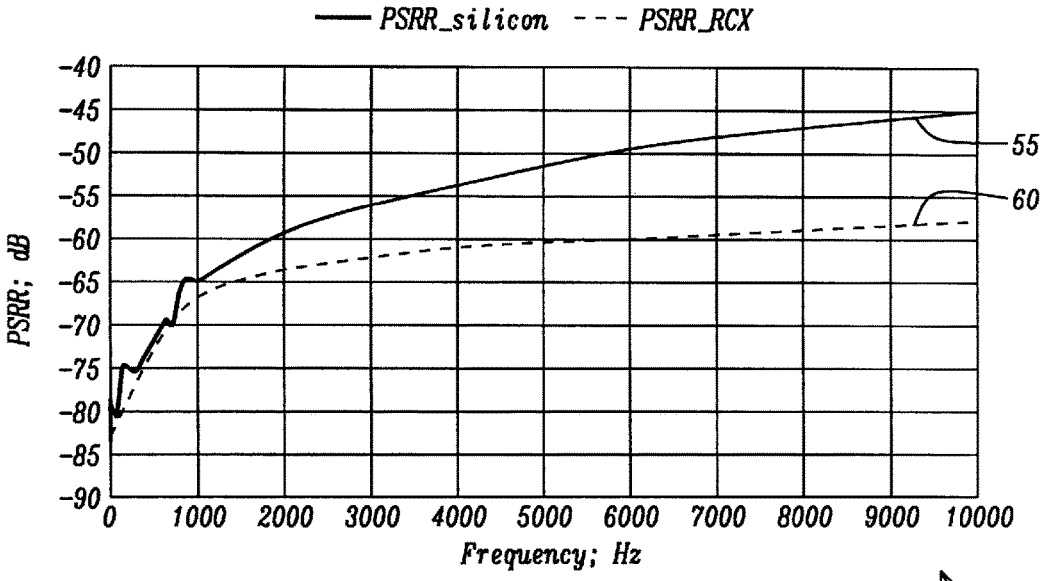
FIG. 2 is an example of the plot of a measured and simulated power supply rejection ratio (PSRR) as a function of frequency.

FIG. 2 is an example of the plot of a measured and simulated power supply rejection ratio (PSRR) as a function of frequency. FIG. 2 PSRR versus frequency plot 50 compares the measured PSRR plot 55 and the simulated PSRR plot 60. At low frequency below 1000 Hz (e.g. 1 kHz), the measured PSRR 55 and simulated PSRR 60 are equal in magnitude. For frequencies above 1000 Hz, the measured PSRR 55 deviates from the simulated. At 10 kHz frequency, the measured PSRR 55 is approximately 20 dB worse than the simulated PSRR 60. The observed degradation is associated with the parasitic capacitance of the bias line.

Figure 3:
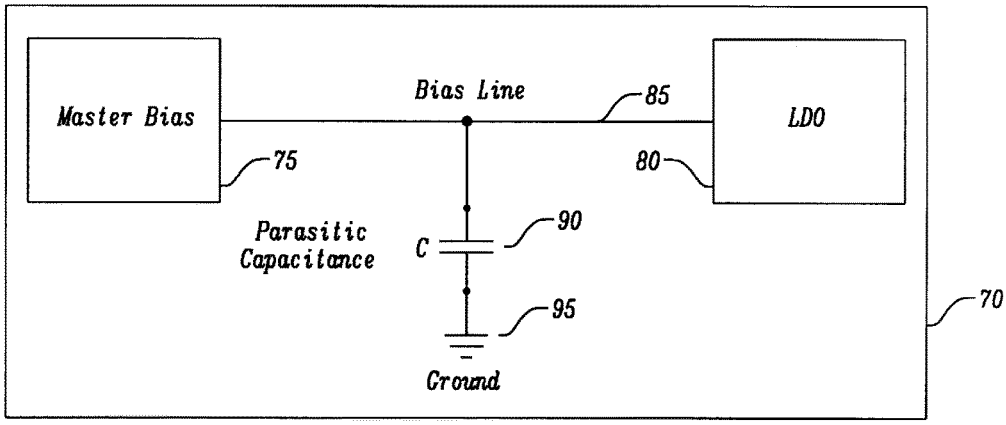
FIG. 3 is an example of a high level diagram of a Master Bias, an LDO, connecting bias line, and a bias line parasitic capacitance.

FIG. 3 is an example of a high level diagram of a Master Bias, an LDO, connecting bias line, and a bias line parasitic capacitance. The system 70 is shown comprising of a Master Bias function 75, a low dropout (LDO) regulator 80, a bias line 85, and a parasitic capacitance 90. The parasitic capacitance 90 is illustrated as the capacitance between the Bias Line and ground potential 95.

Figure 4:
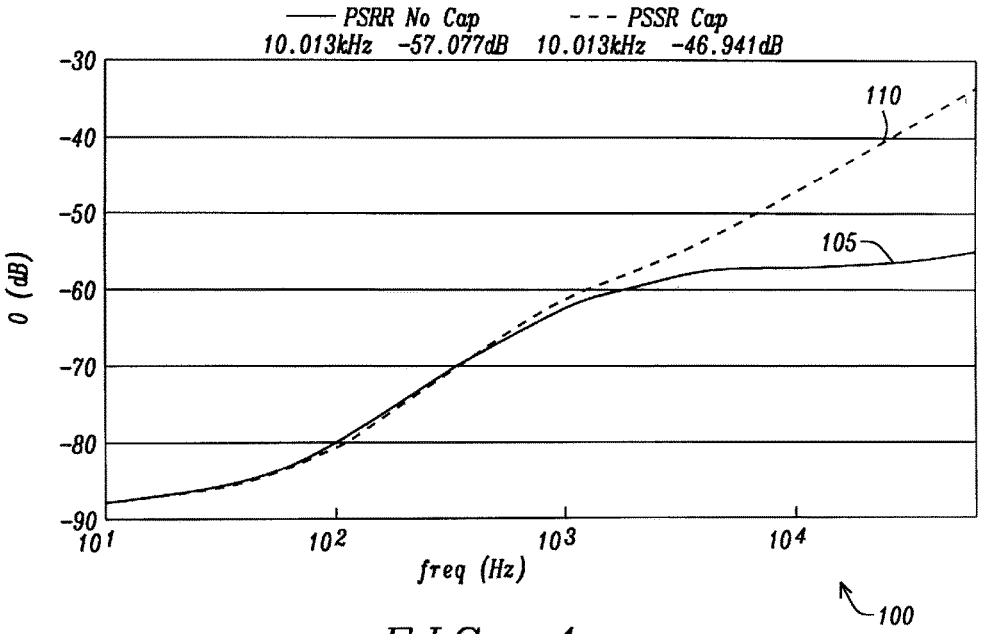
FIG. 4 is a plot of a simulated power supply rejection ratio (PSRR) as a function of the logarithm of frequency with and without a parasitic capacitance on the bias line.

FIG. 4 plots the power supply rejection ratio (PSRR) as a function of logarithm of frequency for a low drop-out (LDO) regulator as illustrated in FIG. 3. The PSRR simulation without a 500 fF capacitance on the bias line is shown as PSRR vs frequency curve trace 105. The PSRR simulation with a parasitic capacitance is shown in PSRR vs frequency curve trace 110. As can be observed, the curve trace 105 and curve trace 110 deviate at frequencies above 1 kHz.

Figure 5:
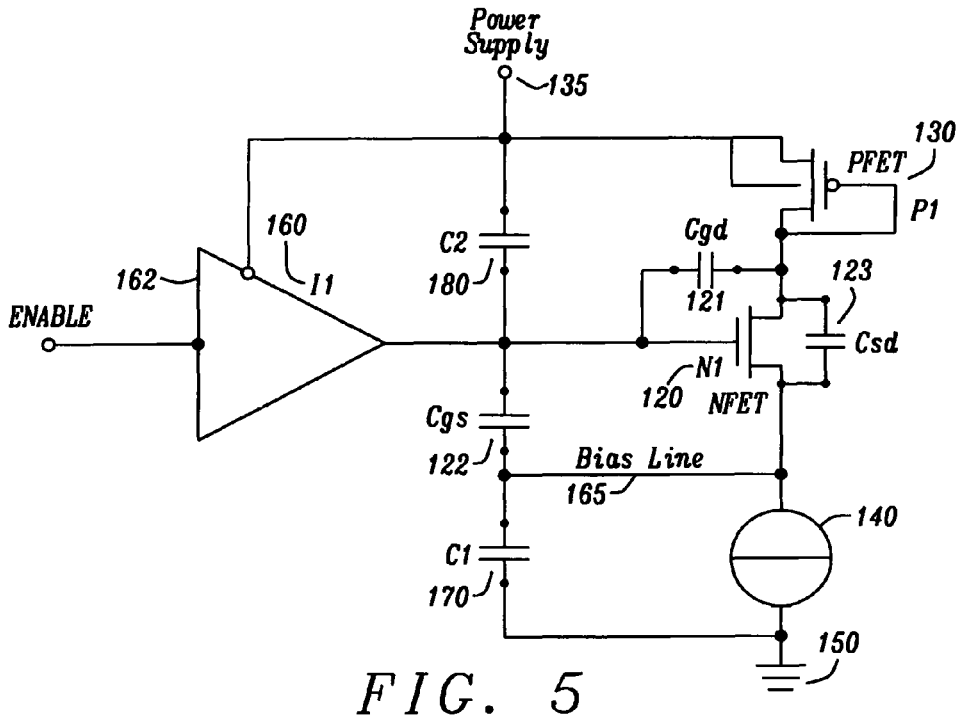
FIG. 5 is a circuit schematic illustrating the internal connections from the bias current from the bias block to the low dropout (LDO) regulator.
Figure 6:
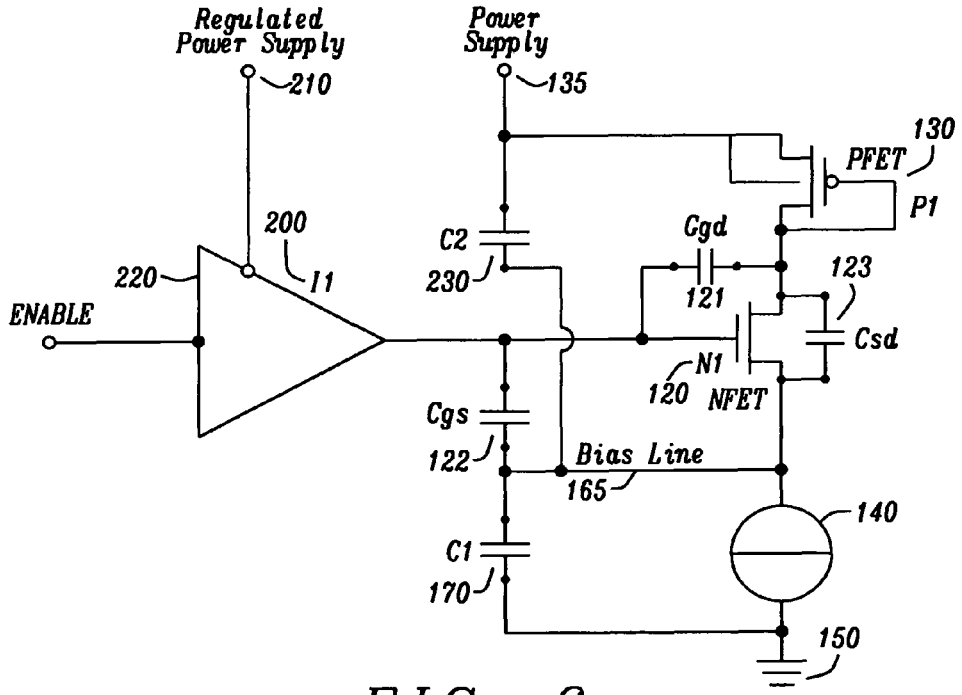
FIG. 6 is a circuit schematic diagram illustrating the internal connections from the bias current from the bias block to the low drop out (LDO) regulator in accordance with a first embodiment of the disclosure.

FIG. 5 illustrates the internal connection of the bias current from the bias block to the low dropout (LDO) regulator. The circuit contains an n-channel MOSFET switch N1 120. The n-channel MOSFET switch N1 120 enables the flow of bias current to the low dropout (LDO) when the LDO is in an enable mode of operation. The circuit contains a p-channel MOSFET 130 between the battery voltage 135, and the n-channel MOSFET switch N1 120. A bias current generator 140 represents the circuit bias between n-channel MOSFET 120 and ground connection 150. A digital gate 160 is represented by I1 which is driven of the LDO supply and controls the gate of n-channel MOSFET N1 120 and is electrically connected to the battery voltage supply 135. The ENABLE function enters the network as a input to circuit element 162. Parasitic capacitance associated with n-channel MOSFET 120 are gate-to-drain capacitance 121, gate-to-source capacitance 122, and source-to-drain capacitance 123. Parasitic capacitance from the routing line 165 to ground connection 150 can be expressed as capacitance element 170. Parasitic capacitance from the routing line 165 to the battery 135 can be expressed as capacitance element 180. In operation, when the LDO is enabled, the gate of n-channel MOSFET 120 rises to the battery voltage. This would include any alternating current (a.c.) signal present on the gate of the n-channel MOSFET 120. The alternating current (a.c.) signal leads to coupling into the discussed bias line 165 leading to degradation of the power supply rejection ratio (PSRR). Note that this is not a function of an n-channel MOSFET, but will also be true if the switch was a p-channel MOSFET FIG. 6 is a circuit schematic diagram illustrating the internal connections from the bias current from the bias block to the low drop out (LDO) regulator in accordance with a first embodiment of the disclosure. The circuit contains an n-channel MOSFET switch N1 120. The n-channel MOSFET switch N1 120 enables the flow of bias current to the low dropout (LDO) when the LDO is in an enable mode of operation. The circuit contains a p-channel MOSFET 130 between the battery voltage 135, and the n-channel MOSFET switch N1 120. A bias current generator 140 represents the circuit bias between n-channel MOSFET 120 and ground connection 150. A circuit 200 is represented by I1 controls the gate of n-channel MOSFET N1 120. The circuit 200 is electrically connected to regulated power supply 210. With the electrical connection to VREG, the circuit utilizes a ripple free/regulated/filtered supply. The ENABLE function enters the network as a input to circuit element 220. Parasitic capacitance associated with n-channel MOSFET 120 are gate-to-drain capacitance 121, gate-to-source capacitance 122, and source-to-drain capacitance 123. Parasitic capacitance from the routing line 165 to ground connection 150 can be expressed as capacitance element C1 170. Parasitic capacitance from the routing line 165 to the battery 135 can be expressed as capacitance element C2. This would include any alternating current (a.c.) signal present on the gate of the n-channel MOSFET 120. The alternating current (a.c.) signal leads to coupling into the discussed bias line 165 leading to degradation of the power supply rejection ratio (PSRR).

In this embodiment, as illustrated in FIG. 6, the modification of FIG. 5 is the utilization of the circuit element I1 200 with the regulated supply which has more desirable features for the network. The regulated voltage source has a high power supply rejection ratio (PSRR) for a low dropout (LDO) In addition, the capacitance C2 which is the parasitic capacitance from the routing line 165 to the battery 135 can be minimized by design layout. With the combined influence of the utilization of the voltage regulated supply, and the lowering of C2 capacitance using design layout and improved floor planning an improved PSRR is achieved.

Figure 7:
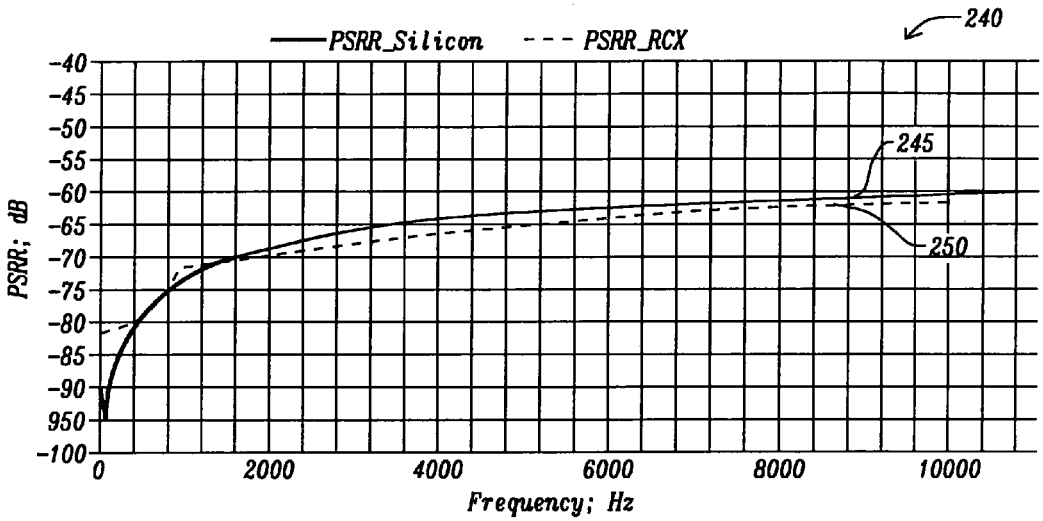
FIG. 7 is a plot of the measured and simulated power supply rejection ratio (PSRR) as a function of frequency in accordance with the first embodiment of the disclosure.

FIG. 7 is a plot of the measured and simulated power supply rejection ratio (PSRR) as a function of frequency in accordance with the first embodiment of the disclosure. In the plot 240, the simulated PSRR 245 is compared to the measured PSRR 250. From the plot 240, there is no evidence of PSRR degradation with frequency as a result of the reduced bias line parasitic capacitance.

Figure 8:
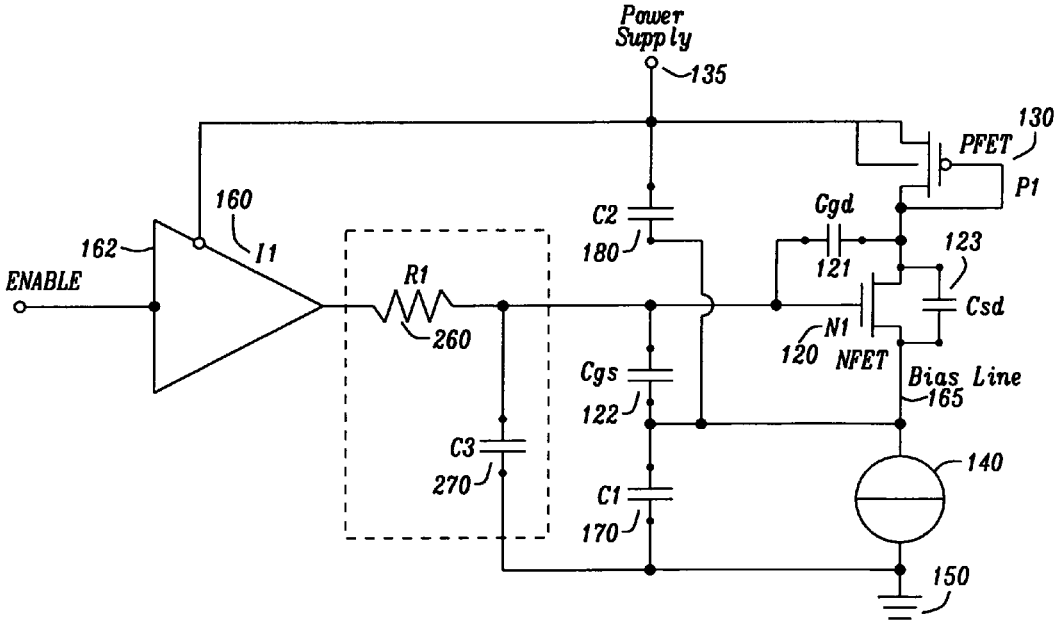
FIG. 8 is a circuit schematic diagram illustrating the internal connections from the bias current from the bias block to the low drop out (LDO) regulator in accordance with a second embodiment of the disclosure.

FIG. 8 is a circuit schematic diagram illustrating the internal connections from the bias current from the bias block to the low drop out (LDO) regulator in accordance with a second embodiment of the disclosure. The circuit contains an n-channel MOSFET switch N1 120. The n-channel MOSFET switch N1 120 enables the flow of bias current to the low dropout (LDO) when the LDO is in an enable mode of operation. The circuit contains a p-channel MOSFET 130 between the battery voltage 135, and the n-channel MOSFET switch N1 120. A bias current generator 140 represents the circuit bias between n-channel MOSFET 120 and ground connection 150. A circuit 160 is represented by I1 is electrically connected to the power supply 135. The ENABLE function enters the network as an input to circuit element 162. Parasitic capacitance associated with n-channel MOSFET 120 are gate-to-drain capacitance 121, gate-to-source capacitance 122, and source-to-drain capacitance 123. Parasitic capacitance from the routing line 165 to ground connection 150 can be expressed as capacitance element C1 170. Parasitic capacitance from the routing line 165 to the battery 135 can be expressed as capacitance element C2 180.

In this second embodiment, the modification includes a low pass filter (LPF) represented as a resistor R1 260 and capacitor C3 270. The resistor element R1 260 is in series between I1 160 and the gate of n-channel MOSFET 120. The capacitor C3 270 is electrically connected to the output of the resistor R1 260 and the ground connection 150, forming an RC network. In this embodiment, any network that provides the function for a low pass filter can achieve the equivalent results. The resistor element R1 and the capacitor element C3 can be implemented using passive or active elements, including metal oxide semiconductor (MOS) field effect transistors.

Figure 9:
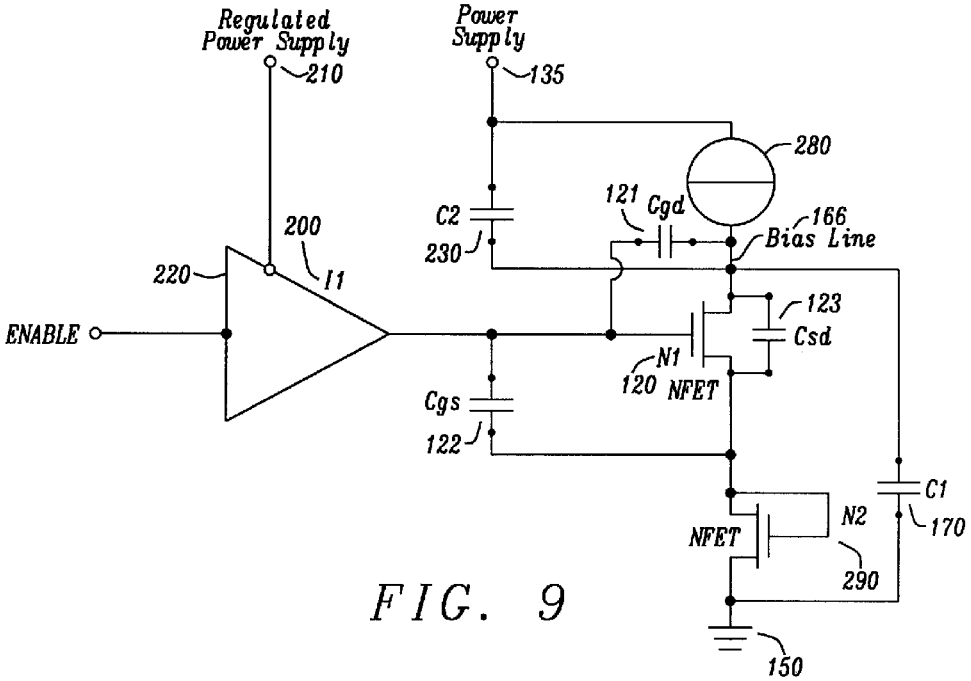
FIG. 9 is a circuit schematic diagram illustrating the internal connections from the bias current from the bias block to the low drop out (LDO) regulator in accordance with a third embodiment of the disclosure.

FIG. 9 is a circuit schematic diagram illustrating the internal connections from the bias current from the bias block to the low drop out (LDO) regulator in accordance with a third embodiment of the disclosure. FIG. 9 is a circuit schematic diagram illustrating the internal connections from the bias current from the bias block to the low drop out (LDO) regulator in accordance with a first embodiment of the disclosure. The circuit contains an n-channel MOSFET switch N1 120. The n-channel MOSFET switch N1 120 enables the flow of bias current to the low dropout (LDO) when the LDO is in an enable mode of operation. The circuit contains a bias current network 280 between the power supply 135, and the n-channel MOSFET switch N1 120. A "On MOSFET" NFET N2 290 is electrically connected bias between n-channel MOSFET 120 and ground connection 150. A circuit 200 is represented by I1 which controls the gate of n-channel MOSFET N1 120. The circuit 200 is electrically connected to the regulated voltage 210. With the electrical connection to the regulated voltage, the circuit utilizes a ripple free/regulated/filtered supply. The ENABLE function enters the network as an input to circuit element 220. Parasitic capacitance associated with n-channel MOSFET 120 are gate-to-drain capacitance 121, gate-to-source capacitance 122, and source-to-drain capacitance 123. Parasitic capacitance from the bias line 166 to ground connection 150 is capacitance element C1 170, the bias line should be shielded with power supply track running below it to reduce C1 this avoids degradation of high frequency PSRR. Parasitic capacitance from the bias line 166 to the power supply 135 can be expressed as capacitance element C2 230. The bias line 166 is the line between the bias circuit 280 and the n-channel MOSFET 120. This would include any alternating current (a.c.) signal present on the gate of the n-channel MOSFET 120. The alternating current (a.c.) signal leads to coupling into the discussed bias line 165 leading to degradation of the power supply rejection ratio (PSRR). In this embodiment, the utilization of the circuit element I1 200 with the regulated power supply 210 which has more desirable features for the network. The regulated voltage source has a high power supply rejection ratio (PSRR) for a low dropout (LDO) In addition, the parasitic capacitances can be minimized by design layout. With the combined influence of the utilization of the regulated voltage supply, and the lowering of parasitic capacitances using design layout and improved floor planning an improved PSRR is achieved.

Figure 10:
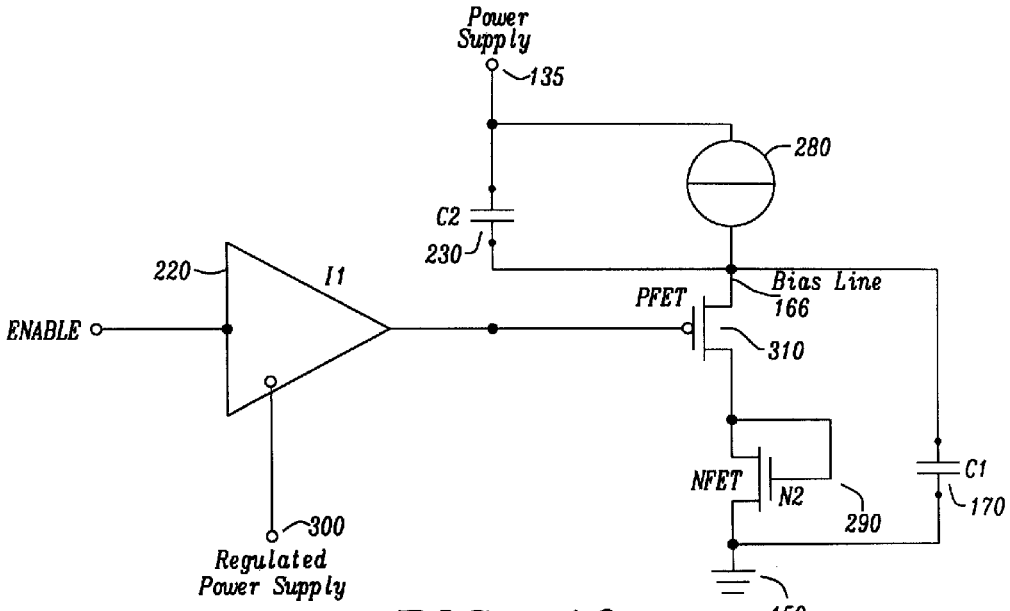
FIG. 10 is a circuit schematic diagram illustrating the internal connections from the bias current from the bias block to the low drop out (LDO) regulator in accordance with a fourth embodiment of the disclosure.

FIG. 10 is a circuit schematic diagram illustrating the internal connections from the bias current from the bias block to the low drop out (LDO) regulator in accordance with a fourth embodiment of the disclosure. The circuit contains a p-channel MOSFET switch PFET 310. The p-channel MOSFET switch 310 enables the flow of bias current to the low dropout (LDO) when the LDO is in an enable mode of operation. The circuit contains a bias current network 280 between the battery voltage 135, and the p-channel MOSFET switch 310. A "On MOSFET" NFET N2 290 is electrically connected bias between p-channel MOSFET 310 and ground connection 150. A digital gate 220 is represented by I1 which is driven of the LDO supply and controls the gate of p-channel MOSFET 310 and is electrically connected to the regulated voltage supply 300. With the electrical connection to the regulated voltage supply, the circuit utilizes a ripple free/regulated/filtered supply. The ENABLE function enters the network as an input to circuit element 220. Parasitic capacitance associated with p-channel MOSFET 310 are gate-to-drain capacitance, gate-to-source capacitance, and source-to-drain capacitance (not shown). Parasitic capacitance from bias line 166 to ground connection 150 can be expressed as capacitance element C1 170, the bias line should be shielded with power supply track running below it to reduce C1 this avoids degradation of high frequency PSRR. Parasitic capacitance from the bias line 166 to the battery 135 can be expressed as capacitance element C2 230. The bias line 166 is the line between the bias circuit 280 and the p-channel MOSFET 310. In this embodiment, the utilization of the circuit element I1 220 with the regulated voltage supply 300 which has more desirable features for the network. The regulated voltage source has a high power supply rejection ratio (PSRR) for a low dropout (LDO) In addition, the parasitic capacitances C1 170 and C2 230 can be minimized by design layout. With the combined influence of the utilization of the regulated voltage supply, and the lowering of C1 170 and C2 230 capacitance using design layout and improved floor planning an improved PSRR is achieved.

Figure 11:
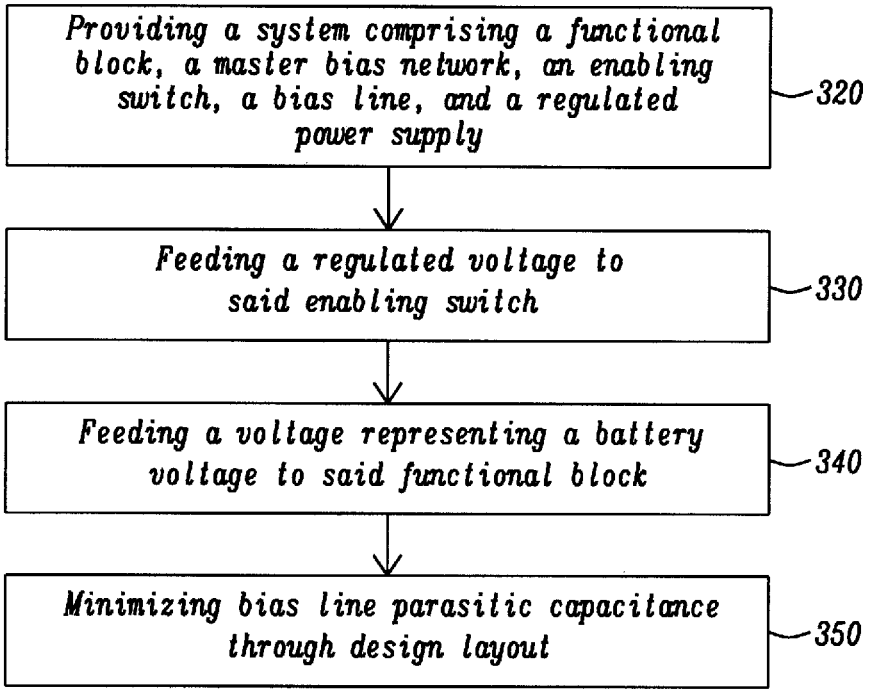
FIG. 11 is a flow chart of the method of providing a system with improved power supply rejection ratio (PSRR).

FIG. 11 illustrates a method of improved power supply rejection ratio (PSRR) frequency dependence in a system. The method includes (1) providing a system comprising a functional block, a master bias network, an enabling switch, a bias line, and a regulated power supply 320, (2) feeding a regulated voltage to said enabling switch 330, (3) feeding a voltage representing a battery voltage to said functional block 340, and (4) minimizing bias line parasitic capacitance through design layout 350. In this method, the functional block can be a low dropout (LDO) regulator.

A second method for improved power supply rejection ratio (PSRR) frequency dependence in a system includes (1) providing a system comprising a functional block, a master bias network, an enabling switch, a bias line, a low pass filter (LPF) and a regulated power supply, (2) feeding a regulated voltage to said enabling switch, (3) filtering the output of said enable switch using said low pass filter (LPF), and (4) minimizing bias line parasitic capacitance through design layout.

The low dropout (LDO) regulator can be defined using bipolar transistors, or metal oxide semiconductor field effect transistors (MOSFETs). The LDO regulator can be formed in a complementary metal oxide semiconductor (CMOS) technology and utilize p-channel and re-channel field effect transistors (e.g. PFETs and NFETs, respectively). The LDO regulator can be formed in a bipolar technology utilizing homo-junction bipolar junction transistors (BJT), or hetero-junction bipolar transistors (HBT) devices. The LDO regulator can be formed in a power technology utilizing lateral diffused metal oxide semiconductor (LDMOS) devices. The LDMOS devices can be an n-type LDMOS (NDMOS), or p-type LDMOS (PDMOS). The LDOvoltage regulator can be formed in a bipolar-CMOS (BiCMOS) technology, or a bipolar-CMOS-DMOS (BCD) technology. The LDO regulator can be defined using both planar MOSFET devices, or non-planar FinFET devices.

As such, a novel voltage regulator with improved voltage regulation are herein described. The improvement is achieved with minimal impact on silicon area or power usage. The improved low dropout (LDO) regulator circuit improves voltage regulation with improved Power Supply Rejection Ratio (PSRR) frequency characteristics by reduction of the parasitic capacitance associated with the bias line. Other advantages will be recognized by those of ordinary skill in the art. The above detailed description of the disclosure, and the examples described therein, has been presented for the purposes of illustration and description. While the principles of the disclosure have been described above in connection with a specific device, it is to be clearly understood that this description is made only by way of example and not as a limitation on the scope of the disclosure.

What is claimed:

1. A system with improved power supply rejection ratio (PSRR), the system comprising:

a first power supply, wherein said first power supply is regulated;

a master bias network providing bias currents to a plurality of functional blocks via a plurality of bias lines, wherein said master bias network comprises:

a global bias current source, configured to generate bias currents to the plurality of functional blocks;

a first switch for each functional block provided with bias current, wherein the first switch is configured to be supplied by the regulated first power supply, to receive an enable signal, and upon receiving the enable signal to activate for each functional block a respective second switch enabling a flow of the bias current from the global bias current source to the respective functional block if the respective functional block is in enable mode or, if the respective functional block is disabled, disable the flow of bias current to the respective functional block;

said second switch connected via a bias line between the respective functional block and the global bias current source; and said bias line;

said plurality of functional blocks supplied by a second power supply; and said second power supply.

2. The system of claim 1 wherein said first power supply, is ripple free.

3. The system of claim 1 wherein a parasitic capacitance between said first power supply, and said bias lines is minimized through design layout.

4. The system of claim 1 wherein one of said functional block is a low drop-out (LDO) regulator.

5. The system of claim 4 wherein said low dropout regulator is powered by said second power supply.

6. The system of claim 1 wherein said second switch is an n-channel MOSFET transistor, wherein said first switch is connected to a gate of the n-channel MOSFET transistor.

7. The system of claim 1, wherein said first power supply is regulated and has negative polarity.

8. The system of claim 7 wherein the second switch is a p-channel MOSFET transistor and wherein said enabling switch is electrically coupled to a MOSFET gate of the second switch.

9. The system of claim 1, wherein the second power supply is a battery.

10. A system with improved power supply rejection ratio (PSRR), the device comprising:

a power supply;

a master bias network providing bias currents to a plurality of functional blocks via a plurality of bias lines, wherein said master bias block comprises:

a global bias current source, configured to generate bias currents to the plurality of functional blocks;

a first switch for each functional block provided with bias current wherein the first switch is configured to be supplied by the power supply, to receive an enable signal, and upon receiving the enable signal to activate for each functional block a respective second switch enabling a flow of the bias current from the global bias current source to the respective functional block if the respective functional block is in enable mode or, if the respective functional block is disabled, disable the flow of bias current to the respective functional block;

a low pass filter electrically coupled between an output of said first switch and a gate of said second switch;

said second switch connected via a bias line between the respective functional block and the global bias current source; and said plurality of functional blocks electrically coupled to said low pass filter; and a power supply.

11. The system of claim 10 wherein said a functional block is a low drop-out (LDO) regulator.

12. The system of claim 10 wherein said second switch is a MOSFET n-channel transistor and said low pass filter (LPF) is electrically coupled to a MOSFET gate of said n-channel MOSFET transistor.

13. The system of claim 10 wherein said low pass filter (LPF) comprises a resistor and capacitor element.

14. The system of claim 10 wherein said low pass filter (LPF) comprises metal oxide semiconductor field effect transistor (MOSFET) elements configured to provide a low pass filter (LPF) operation.

15. A method of improved power supply rejection ratio (PSRR) frequency dependence in a system comprising the steps of:

providing a system comprising a multitude of functional blocks, a first regulated power supply, a second power supply, a master bias network configured to provide bias currents to the functional blocks comprising a master bias current source, configured to generate bias currents to the plurality of functional blocks, and for each functional block a first switch, a bias line, and a second switch, wherein the first switch is configured to activate the second switch upon receiving the enabling signal to enable a flow of bias current from the global bias current source to a respective function block in enable mode or, when the respective functional block is disabled, disable a flow of bias current to the respective functional block;

feeding the first regulated power supply to said first switch;

feeding the second power supply to said multitude of functional block: and minimizing bias line parasitic capacitance for improved power supply rejection ratio (PSRR) through design layout.

16. The method of improved power supply rejection ratio (PSRR) of claim 15, wherein one of said functional blocks is a low dropout (LDO) regulator.

17. A method of improved power supply rejection ration (PSRR) frequency dependence in a system comprising the steps of:

providing a system comprising a multitude of functional blocks, a power supply, a master bias network configured to provide bias currents to the functional blocks comprising a master bias current source, configured to generate bias currents to the plurality of functional blocks, and for each functional block, a first switch configured to receive an enabling signal, a bias line, a low pass filter (LPF), and a second switch, wherein the first switch is configured to activate the second switch upon receiving the enabling signal to enable a flow of bias current from the global bias current source to a respective functional block in enable mode or, when the respective functional block is disabled, disable a flow of bias current to the respective functional block;

supplying said first switch by the power supply;

filtering the output of said first switch using said low pass filter (LPF); and minimizing bias line parasitic capacitance for improved power supply rejection ratio (PSSR) through design layout.

* * * * *